US009217316B2

(12) United States Patent
Ehtesham et al.

(10) Patent No.: US 9,217,316 B2
(45) Date of Patent: Dec. 22, 2015

(54) CORRELATING DEPTH ON A TUBULAR IN A WELLBORE

(75) Inventors: Muhammad Asif Ehtesham, Spring, TX (US); Robert L. Pipkin, Marlow, OK (US); Tim Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 691 days.

(21) Appl. No.: 13/495,849

(22) Filed: Jun. 13, 2012

(65) Prior Publication Data

US 2013/0333883 A1 Dec. 19, 2013

(51) Int. Cl.
*E21B 47/09* (2012.01)
*E21B 43/00* (2006.01)

(52) U.S. Cl.
CPC ..... *E21B 43/00* (2013.01); *E21B 47/09* (2013.01)

(58) Field of Classification Search
CPC ..... E21B 47/09; E21B 23/02
USPC ..... 166/64, 255.1, 206, 239; 175/384, 266, 175/271, 267, 268–270, 274, 284, 286, 291, 175/289
See application file for complete search history.

(56) References Cited

U.S. PATENT DOCUMENTS 2,690,897 A * 10/1954 Clark, Jr. ..... 175/268
2,948,340 A * 8/1960 Bostock et al. ..... 166/215
3,020,958 A * 2/1962 Kenneday ..... 166/118
3,087,546 A * 4/1963 Woolley ..... 166/277
3,130,788 A * 4/1964 Cochran ..... 166/217
5,018,580 A * 5/1991 Skipper ..... 166/298
5,101,895 A * 4/1992 Gilbert ..... 166/55.8
5,156,209 A * 10/1992 McHardy ..... 166/324
5,351,758 A * 10/1994 Henderson et al. ..... 166/277
6,976,507 B1 12/2005 Webb et al.
6,976,831 B2 12/2005 Hunter
7,073,582 B2 7/2006 Connell et al.
7,306,044 B2 12/2007 Connell et al.
7,332,094 B2 2/2008 Abney et al.
7,405,998 B2 7/2008 Webb et al.
7,429,332 B2 9/2008 Surjaatmadja et al.
7,631,698 B2 12/2009 Miller et al.
7,648,179 B2 1/2010 Webb et al.

(Continued)

OTHER PUBLICATIONS

Weatherford, "Inflatable Packers Catalog" Copyright 2008, Printed Jan. 20, 2012 (64 pages).

(Continued)

*Primary Examiner* — Shane Bomar
*Assistant Examiner* — Kipp Wallace
(74) *Attorney, Agent, or Firm* — Scott Brown; Fish & Richardson P.C.

(57) ABSTRACT

Techniques for correlating depth on a tubular in a wellbore include a casing collar locator tool that includes a tubular mandrel defining a bore therethrough; a top sub-assembly and a bottom sub-assembly carried on the tubular mandrel; a profile carried on the tubular mandrel axially between the top sub-assembly and bottom sub-assembly and adjustable between an engaged state defined by the profile extending radially away from the mandrel and a disengaged state defined by the profile refracted towards the mandrel; and a wedge sleeve carried on the tubular mandrel between the top sub-assembly and the bottom sub-assembly and arranged, at least in part, axially adjacent the profile, the wedge sleeve actuatable to urge the profile into at least one of the engaged state or the disengaged state.

22 Claims, 6 Drawing Sheets

(56) References Cited

U.S. PATENT DOCUMENTS

| | | | | |
|---|---|---|---|---|
| 7,677,302 | B2 | 3/2010 | Ehtesham et al. | |
| 7,678,744 | B2 | 3/2010 | Abney et al. | |
| 7,823,663 | B2 * | 11/2010 | Eddison | 175/269 |
| 7,832,477 | B2 | 11/2010 | Cavender et al. | |
| 7,866,400 | B2 | 1/2011 | Steele et al. | |
| 7,886,842 | B2 | 2/2011 | Howard et al. | |
| 7,909,094 | B2 | 3/2011 | Schultz et al. | |
| 7,950,456 | B2 | 5/2011 | Cavender et al. | |
| 7,992,427 | B2 | 8/2011 | Tonmukayakul et al. | |
| 8,024,962 | B2 | 9/2011 | Tonmukayakul et al. | |
| 8,096,362 | B2 | 1/2012 | Steele et al. | |
| 8,162,054 | B2 | 4/2012 | Schultz et al. | |
| 2006/0000608 | A1 | 1/2006 | Surjaatmadja et al. | |
| 2007/0125718 | A1 | 6/2007 | Abney et al. | |
| 2007/0129259 | A1 | 6/2007 | Abney et al. | |
| 2009/0041588 | A1 | 2/2009 | Hunter et al. | |
| 2009/0166040 | A1 | 7/2009 | Cavender et al. | |
| 2010/0004890 | A1 | 1/2010 | Tonmukayakul et al. | |
| 2010/0018294 | A1 | 1/2010 | Tonmukayakul et al. | |
| 2010/0133012 | A1 | 6/2010 | Howard et al. | |
| 2010/0252261 | A1 | 10/2010 | Cavender et al. | |
| 2011/0073295 | A1 | 3/2011 | Steele et al. | |
| 2011/0139453 | A1 | 6/2011 | Schultz et al. | |
| 2011/0170844 | A1 | 7/2011 | Schultz et al. | |
| 2011/0192599 | A1 | 8/2011 | Surjaatmadja et al. | |
| 2011/0209881 | A1 | 9/2011 | Hriscu et al. | |
| 2012/0097396 | A1 | 4/2012 | Stewart et al. | |
| 2012/0118568 | A1 | 5/2012 | Kleefisch et al. | |

OTHER PUBLICATIONS

Weatherford, "ReelFrac Annular Frac Bottomhole Assembly", Copyright 2012, Printed Jun. 12, 2012 (2 pages).

* cited by examiner

CORRELATING DEPTH ON A TUBULAR IN A WELLBORE

BACKGROUND

In some wellbore operations and/or systems, it may be helpful to confirm or correlate a particular depth within the wellbore, such as, for example, to confirm a treatment depth for a particular operation. Depth may be correlated using known reference points on a tubular, such as a casing string. Electric logging tools may detect a magnetic anomaly caused by the relatively high mass of a casing collar on a tubular string, as compared to the tubular joints. A signal may be transmitted to surface equipment that provides an output to be correlated with previous logs and known casing features.

SUMMARY

The present disclosure describes implementations of downhole tools for, in some implementations, correlating depth on a tubular in a wellbore. In an example implementation, a casing collar locator tool includes a tubular mandrel defining a bore therethrough; a top sub-assembly and a bottom sub-assembly carried on the tubular mandrel; a profile carried on the tubular mandrel axially between the top sub-assembly and bottom sub-assembly and adjustable between an engaged state defined by the profile extending radially away from the mandrel and a disengaged state defined by the profile retracted towards the mandrel; and a wedge sleeve carried on the tubular mandrel between the top sub-assembly and the bottom sub-assembly and arranged, at least in part, axially adjacent the profile, the wedge sleeve actuatable to urge the profile into at least one of the engaged state or the disengaged state.

In a first aspect combinable with the example implementation, the wedge sleeve is hydraulically-actuated.

A second aspect combinable with any of the previous aspects further includes a sliding piston sleeve carried on the tubular mandrel; an outer sleeve carried, at least in part, on the sliding piston sleeve, the outer sleeve including a shoulder adjacent an axial end of the sliding piston sleeve; and a spring arranged between the wedge sleeve and the sliding piston sleeve, the spring including a first surface adjacent the axial end of the sliding piston sleeve and a second surface adjacent an end of the moveable wedge sleeve opposite the interface surface.

A third aspect combinable with any of the previous aspects further includes a reservoir in fluid communication with the bore through a fluid passage, the reservoir arranged axially between the sliding piston sleeve and one of the top sub-assembly or the bottom sub-assembly.

A fourth aspect combinable with any of the previous aspects further includes a check valve arranged in the fluid passage between the reservoir and the bore; and a rupture member in fluid communication with the reservoir and an annulus between the tool and a wellbore.

A fifth aspect combinable with any of the previous aspects further includes a reservoir in fluid communication with the bore through a fluid passage, the reservoir arranged axially between the wedge sleeve and one of the top sub-assembly or the bottom sub-assembly.

In a sixth aspect combinable with any of the previous aspects, the profile includes a base surface; and a plateau surface connected to the base surface by one or more angled or curved surfaces.

In a seventh aspect combinable with any of the previous aspects, the plateau surface includes a reduced friction surface relative to the base surface; or a hardened surface relative to the base surface.

In an eighth aspect combinable with any of the previous aspects, the one or more angled surfaces include a first surface angled from the base surface at about 45 degrees or less relative to an axial centerline of the tool; and a second surface angled from the base surface at between about 45 degrees and about 90 degrees relative to the axial centerline of the tool.

A ninth aspect combinable with any of the previous aspects further includes a spring axially arranged between the wedge sleeve and the top sub-assembly; a pin that connects the top sub-assembly to the tubular mandrel, the pin breakable to actuate the wedge sleeve to urge the profile into the disengaged state; and a gap that extends radially about the tubular mandrel between the tubular mandrel and the top sub-assembly adjacent the pin, the tubular mandrel moveable into the gap to release the spring from compression.

In a tenth aspect combinable with any of the previous aspects, the wedge sleeve includes an interface surface that faces one of an uphole axial surface or a downhole axial surface of the profile, the interface surface and the uphole axial surface angled relative to an axial centerline of the tool.

In another example implementation, a method for operating a casing collar locator tool includes running a casing collar locator tool including a profile carried on a tubular mandrel into a wellbore; circulating a fluid to a bore of the tool; adjusting, based on the circulating fluid, a force applied to a moveable wedge sleeve carried on the tubular mandrel axially adjacent the profile; adjusting the profile to one of an engaged state or a disengaged state based on the pressure of the circulating fluid meeting a specified pressure threshold.

A first aspect combinable with the example implementation further includes dropping a member into the bore of the tool to substantially block passage of the fluid downhole of the tool; directing the circulated fluid into a fluid reservoir of the tool adjacent an sliding piston sleeve carried on the mandrel; urging the sliding piston sleeve to compress a spring disposed between the sliding piston sleeve and the wedge sleeve; and urging the wedge sleeve against the profile to adjust the profile to the engaged state.

A second aspect combinable with any of the previous aspects further includes maintaining a pressure of the fluid in the fluid reservoir while substantially ceasing circulation of the fluid through the bore of the tool; and running one or more downhole tools through the bore while the profile is maintained in the engaged state.

A third aspect combinable with any of the previous aspects further includes increasing a pressure of the fluid circulated to the bore to exceed a maximum pressure setpoint of a member is in fluid communication with the fluid reservoir and an annulus of the wellbore; rupturing the member based on the increased fluid pressure to substantially equalize a fluid pressure in the fluid reservoir and an annulus fluid pressure; and adjusting the profile to the disengaged state based on rupturing the member.

A fourth aspect combinable with any of the previous aspects further includes dropping a member into the bore of the tool to substantially block passage of the fluid downhole of the tool; directing the circulated fluid into a fluid reservoir of the tool adjacent the piston; and urging, with the fluid in the fluid reservoir, the wedge sleeve against the profile to adjust the profile to the engaged state.

A fifth aspect combinable with any of the previous aspects further includes decreasing a fluid pressure in the fluid reservoir to adjust the profile to the disengaged state.

A sixth aspect combinable with any of the previous aspects further includes dropping a member into the bore of the tool to substantially block passage of the fluid downhole of the tool.

In a seventh aspect combinable with any of the previous aspects, adjusting the profile to one of an engaged state or a disengaged state based on the pressure of the circulating fluid meeting a specified pressure threshold includes increasing the pressure of the circulated fluid to break a pin coupling a top sub-assembly of the tool to the mandrel; sliding the mandrel into a gap between the mandrel and the top sub-assembly to release a force urging the piston against the profile to maintain the profile in the engaged state; and adjusting the profile to the disengaged state.

An eighth aspect combinable with any of the previous aspects further includes applying a force to the tool to move the tool in the wellbore from a first depth to a second depth; engaging the profile with a collar of a tubular disposed in the wellbore; determining, based on the engagement of the profile with the collar, a change to at least one of the a fluid characteristic of the circulating fluid or the force applied to the tool.

In a ninth aspect combinable with any of the previous aspects, the fluid characteristic includes a fluid pressure or a fluid flow rate.

A tenth aspect combinable with any of the previous aspects further includes maintaining the profile in the engaged state; adjusting a depth of the profile in the wellbore to engage a casing collar with the profile; and determining a change to an operating characteristic of the tool based on the engagement of the casing collar with the profile.

In an eleventh aspect combinable with any of the previous aspects, determining a change to an operating characteristic of the tool includes at least one of determining a reduction or increase of a fluid pressure of the fluid circulated to the bore; or determining a reduction or increase in force used to adjust a depth of the tool in the wellbore.

A twelfth aspect combinable with any of the previous aspects further includes readjusting a depth of the profile in the wellbore to engage a second casing collar with the profile; determining another change to the operating characteristic of the tool based on the engagement of the second casing collar with the profile; and generating at least a portion of a casing log based on successive engagement of the casing collar and the second casing collar with the profile.

In a thirteenth aspect combinable with any of the previous aspects, the casing collar locator tool is arranged in a tubing string apart from a bottom hole assembly and the wellbore includes a cased portion and an uncased openhole portion.

A fourteenth aspect combinable with any of the previous aspects includes correlating a depth of the casing collar locator tool in the cased portion based on engagement of the casing collar locator tool and a casing collar; and determining a position of the bottom hole assembly disposed in the uncased openhole portion based on the correlated depth of the casing collar locator and a specified distance between the casing collar locator and the bottom hole assembly.

In a fifteenth aspect combinable with any of the previous aspects, the uncased openhole portion of the wellbore may be deviated from vertical.

In another example implementation, a downhole tool includes a casing collar locator that includes a tubular mandrel including a bore therethrough; a top sub-assembly carried on the mandrel and adapted to be coupled to a tubing that is run into a wellbore; a bottom sub-assembly carried on the mandrel and adapted to be coupled to a bottom hole assembly; a collar latch carried on the mandrel and adapted to adjust between an actuated position in contact with a casing collar and a deactuated position not in contact with the casing collar in response to a force applied to an axial surface of the collar latch by a force-actuated piston.

A first aspect combinable with the example implementation further includes one or more spring members arranged between the collar latch and the hydraulically-actuated piston, the one or more spring members adapted to apply a spring force to the collar latch based on a hydraulic pressure applied to the piston.

In a second aspect combinable with any of the previous aspects, the collar latch is adapted to radially extend away from the tubular mandrel while in the actuated position.

In a third aspect combinable with any of the previous aspects, the force-actuated piston includes a hydraulically-actuated piston.

Various implementations of a downhole tool for correlating depth on a tubular in a wellbore may have one or more of the following features. For example, the downhole tool may facilitate transmission of a correlated depth of a tubular by locating one or more casing collars installed on the tubular in the wellbore. For instance, the downhole tool may transmit a fluidic pressure spike or reduction to a terranean surface upon location of one or more of the casing collars. As another example, the downhole tool may facilitate an increased tension (e.g., pull) on the tool upon location of one or more of the casing collars. Further, an external radial surface of the downhole tool that translates through the tubular adjacent an inner radial surface of the tubular may include an abrasion-friendly surface such as, for example, a polished surface, hardened surface, bearing surface, inclined/declined surface, or other surface that may reduce drag and wear caused by continual or near continual contact with the inner radial surface of the tubular. As another example, the downhole tool may correlate depth of a number of different tubular diameters. Further, the downhole tool may be activated on demand, e.g., through hydraulic pressure or other techniques. The downhole tool may also be used between coil tubing (CT), joint tubing (JT) or any combination of CT and JT, or in a completion (e.g., perforating, fracturing, or other completion operation) string of tubing. As another example, the downhole tool may include an erosion friendly inner diameter profile that allows, for example, sand-laden fluids to be circulated therethrough more easily. In addition, the inner diameter may be relatively large as compared to conventional tools for correlating depth on a tubular, thereby allowing, for instance, larger tools to be run through the downhole tool and/or more sand-laden fluids to be circulated therethrough.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DETAILED DESCRIPTION

Figure 1:
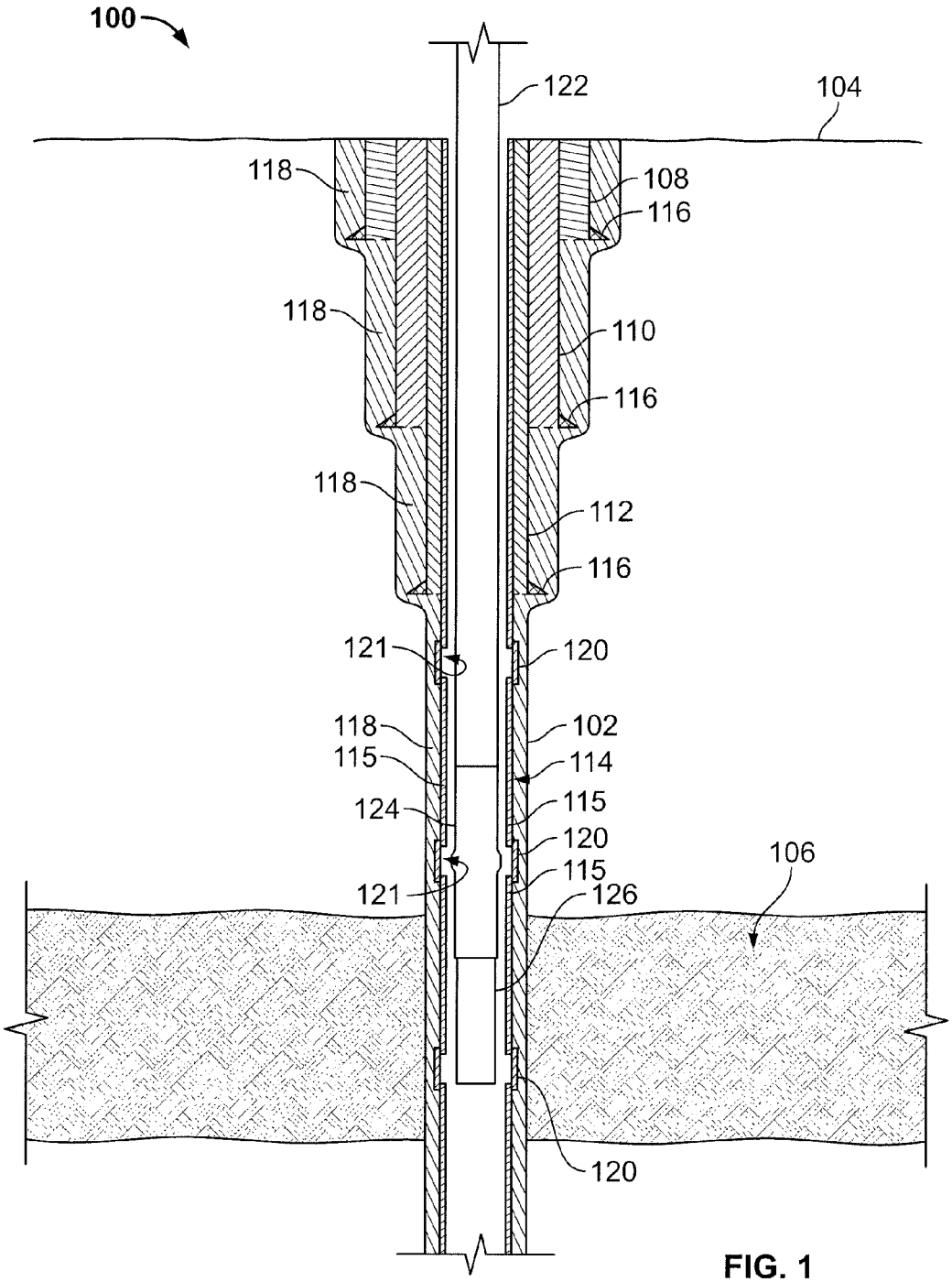
FIG. 1 illustrates an example system including a downhole tool for correlating depth on a tubular in a wellbore.

FIG. 1 illustrates an example system 100 including a downhole tool 124 for correlating depth on a tubular in a wellbore. In some implementation, the downhole tool 124 may include or include a casing collar locator tool for correlating depth on a casing (e.g., a production casing) installed within a wellbore. As illustrated, system 100 includes a wellbore 102 that extends from a terranean surface 104 to and/or through one or more subterranean zones, such as a subterranean zone 106 (e.g., a hydrocarbon bearing geologic formation). The downhole tool 124 is lowered into the wellbore 102 from a tubing string 122 (e.g., a coiled tubing string, a joint tubing string, or a combination of CT and JT) to a particular depth within the wellbore 102. As explained in more detail below, the downhole tool 124, in some implementations, may be lowered into the wellbore 102 in a disengaged position and subsequently actuated (e.g., by hydraulic pressure, mechanical techniques, or otherwise) downhole. Once actuated, the downhole tool 124 may be moved (e.g., raised) within the wellbore 102 in order to correlate one or more depths in the wellbore 102 according to, for example, casing collars located on the tubular in the wellbore 102. For example, as the downhole tool 124 is moved adjacent to or past a particular casing collar, the tool 124 may transmit information (e.g., through a hydraulic pressure spike, increased tensile pull, or other techniques) to the terranean surface 104 to indicate the tool's location near that particular casing collar.

FIG. 1 generally illustrates the wellbore 102 already formed (e.g., post-drilling) to a specified depth; however, the present disclosure also contemplates that system 100 is illustrated during formation of the wellbore 102. The drilling assembly that forms the wellbore 102, however, may be any appropriate assembly or drilling rig used to form wellbores or boreholes in the Earth.

In some implementations, the drilling assembly may be deployed on a body of water rather than the terranean surface 104. For instance, in some implementations, the terranean surface 104 may be an ocean, gulf, sea, or any other body of water under which hydrocarbon-bearing formations may be found. In short, reference to the terranean surface 104 includes both land and water surfaces and contemplates forming and/or developing one or more wellbores 102 from either or both locations.

Although illustrated as substantially vertical, the wellbore 102 may be a vertical wellbore, a directional wellbore, such as a horizontal wellbore coupled to a radius that turns substantially vertical to the terranean surface 104, or any other form of wellbore. For example, in some implementations, the downhole tool 200 may be coupled to, for instance, coiled tubing, in order to reach locations in a substantially horizontal wellbore.

As illustrated, system 100 includes a number of casings installed in the wellbore 102 from at or near the terranean surface 104 to one or more depths in the wellbore 102. For instance, as illustrated, a conductor casing 108 is installed (e.g., with cement 118) a short distance from the terranean surface 104. Generally, the conductor casing 108 may help prevent the wellbore 102 from caving into the bore during formation. The conductor casing 108 (and other illustrated casings 110, 112, and/or 114) may be at least partially secured in the wellbore 102 with one or more casing shoes 116, as shown in FIG. 1.

Installed below the conductor casing 108 is a surface casing 110. Generally, the surface casing 110 may be a relatively large diameter pipe string set to extend from at or near the terranean surface 104 to a point in the wellbore 102 below the conductor casing 108. The surface casing 110, for example, may help protect fresh-water aquifers, provide minimal pressure integrity, and/or support a diverter or a blowout preventer. In some implementations, casing(s) downhole from the surface casing 110 (e.g., casings 112, and 114) may be suspended at the top and inside of the surface casing 110.

Installed to extend below the surface casing 110 is an intermediate casing 112. Generally, the intermediate casing 112 is set in place after the surface casing 110 and before the production casing 114, and may provide protection against caving of formations into the wellbore 102. The intermediate casing 112 may also enable the use of drilling fluids of different density necessary for the control of lower formations.

Installed to extend to a particular desired depth from the terranean surface 104 is the production casing 114. Generally the production casing 114 is a tubular casing string that is installed in the wellbore 102 to set across one or more reservoir intervals and within which the primary completion components (e.g., packers, ESP, sleeves, and other components) are installed.

As illustrated, the production casing 114 consists of tubing segments 115 joined by casing collars 120. In some implementations, the tubing segments 115 may be threadingly coupled to the casing collars 120, thereby forming a string of segments 115 in the wellbore 102. The casing collars 120, for instance, may be shorter segments of tubing that are internally threaded to join the segments 115. In some implementations, two particular segments 115 may not abut when threaded into a casing collar 120 that joins the two segments 115, thereby defining a notch 121 between ends of the segments 115. During operation of example implementations of the downhole tool 124 (as described more fully below), a portion of the tool 124 may engage (e.g., contact, touch, slide against, or otherwise) one or more of the segments 115 and casing collar 120 at the notch 121. Upon such engagement, the downhole tool 124 may signal (e.g., through a pressure spike, increased pull force, or otherwise) the location of the tool 124 in the wellbore 102 as adjacent the particular casing collar 120. Through such a signal, a particular depth of the downhole tool 124 in the wellbore 102 may be correlated, calculated, or otherwise determined.

As illustrated, in some implementations, the downhole tool 124 is coupled to a bottom hole assembly (BHA) 126. Although shown as directly coupled, in some implementations, a tubing string (e.g., coiled tubing, jointed tubing, or a combination thereof) may be installed between the downhole tool 124 and the BHA 126, and in some cases, many hundreds or thousands of feet between.

Figure 2:
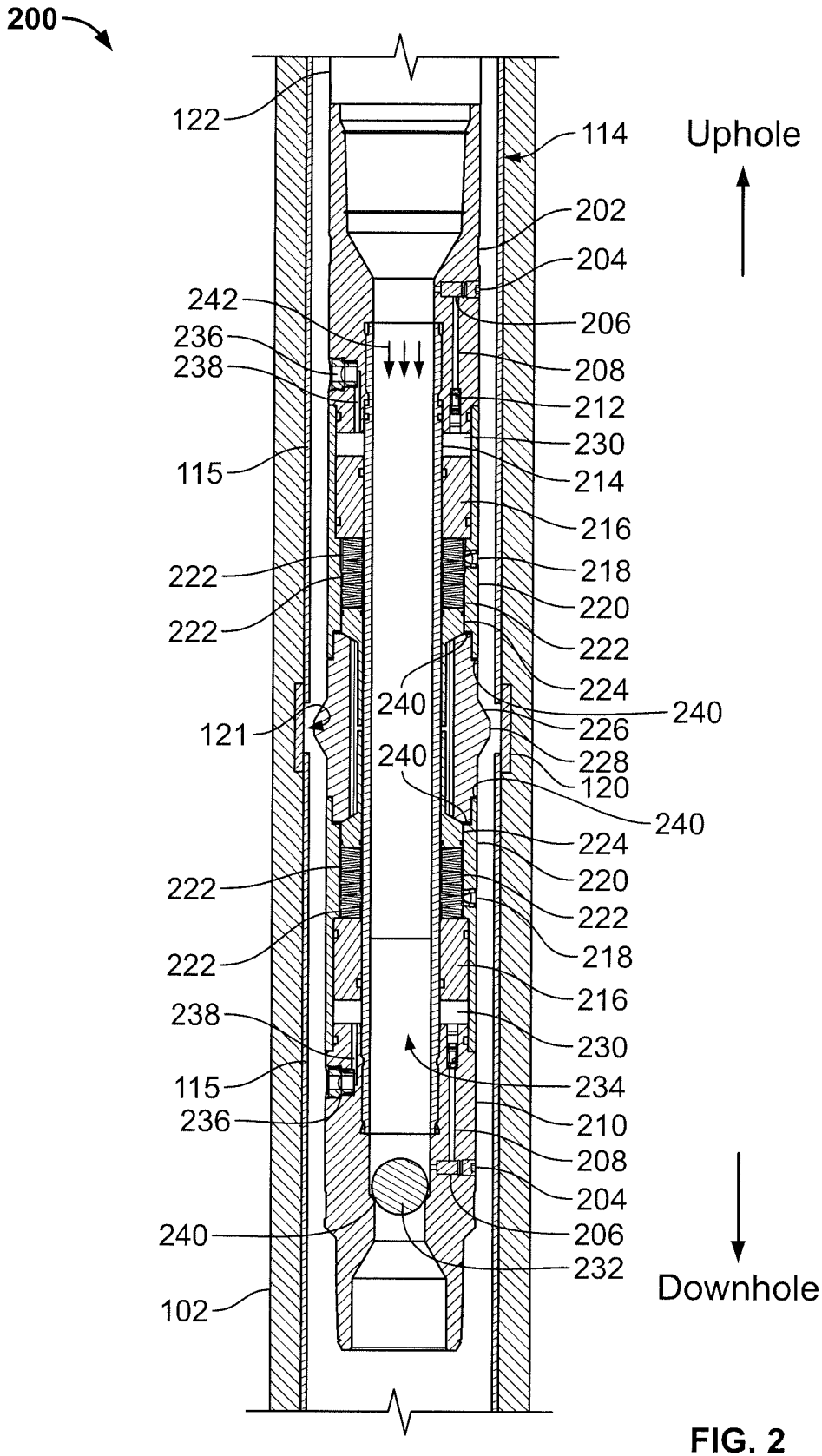
FIG. 2 is a sectional view of an example implementation of a downhole tool for correlating depth on a tubular in a wellbore.

FIG. 2 is a sectional view of an example implementation of a downhole tool 200 for correlating depth on a tubular in a wellbore. For example, in some implementations, the downhole tool 200 may be used in system 100 and run into the wellbore 102 within the production casing 114. As illustrated in FIG. 2, for instance, the downhole tool 200 is shown coupled (e.g., threadingly) to the tubing string 122 within the production casing 114 adjacent a notch 121 defined by a casing collar 120 that joins two segments 115 of the production casing 114. Generally, the downhole tool 200 may be actuated by a combination of hydraulic pressure, and mechanical (e.g., spring) force.

The illustrated downhole tool 200 includes a top sub-assembly ("sub") 202 and bottom sub 210 that facilitate coupling engagement (e.g., threadingly) with, for instance, the tubing string 122 at the uphole end of the tool 200 and the BHA 126 (not shown in FIG. 2) at the downhole end of the tool 200. A mandrel 214 extends between and is coupled to the top sub 202 and bottom sub 210 and defines a bore 234 that extends along a centerline axis of the tool 200. The bore 234, for example, may define a maximum diameter through which a tool, fluid, or object (e.g., a ball 232 as shown) may pass. A downhole end of the bore 234 is adjacent a seat 240 on which a ball 232 can land in the tool 200.

The illustrated tool 200 includes outer sleeve 220 that define a portion of an exterior radial surface of the tool 200 at the uphole and downhole ends of the tool 200. As shown, the outer sleeve 220 includes shoulders 240 that face uphole and downhole ends of the tool 200, respectively, and abut the collar latch keys 226 during actuation of the tool 200.

Piston sleeves 216 are arranged radially between the outer sleeve 220 and the mandrel 214 within fluid reservoirs 230. As illustrated, each piston sleeve 216 includes a first axial surface that is nearest the respective top sub 202 or bottom sub 210 and a second axial surface that is nearest and shown abutting a shoulder of the adjacent outer sleeve 220. During operation, as explained in more detail below, the piston sleeves 216 may move (e.g., due to increasing/decreasing hydraulic pressure or mechanical force) within the fluid reservoirs 230 to contact one or more springs 222.

The springs 222, in the illustrated implementation, include one or more disc springs (e.g., Belleville washers) stacked between the piston sleeves 216 and wedge sleeves 224. The springs 222, however, may be other forms of potential energy devices, such as, for example, coiled springs, elastomeric devices, or other devices. For example, in some alternative implementations, the springs 222 illustrated in FIG. 2 each comprise a single coiled spring arranged to apply a spring force to a respective wedge sleeve 224, for instance, upon contact of the piston sleeve 216 with the springs 222. In any event, the springs 222 may be selected based, for example, on a collective spring force exertable by the springs 222 on the wedge sleeves 224. Further, the springs 222 may be selected based on a desired pull out force of the tool 200 from the wellbore 102 or from the notch 121.

The illustrated wedge sleeves 224 are arranged radially between the mandrel 214 on one side and the outer sleeve 220 and collar latch keys 226 on the other side. In particular, the illustrated wedge sleeves 224 include an angled (e.g., with respect to an axial centerline the tool 200) shoulder that interfaces with an angled surface of the collar latch keys 226. As described in more detail below, during operation, the angled shoulder of the wedge sleeves 224 may contactingly engage the angled surface of the collar latch keys 226 in order to radially extend the collar latch keys 226 towards the production casing 114.

The collar latch keys 226 includes a profiled exterior (e.g., radial) surface, as illustrated, including a finger 228 that extends from the collar latch 226. The finger 228 may include a symmetrically angled profile, as illustrated, with a peak surface that may be treated (e.g., hardened for wear reduction), smoothed (e.g., for reduced friction engagement with the casing segments 115 and/or casing collar 120), and/or provided with a bearing surface. For example, in some implementations, the peak surface of the finger 228 may include one or more ball bearings or other bearing components that help facilitate movement of the downhole tool 200 against casing segments 115 and/or past the casing collar 120 as the downhole tool 200 is moved in the wellbore 102.

In some implementations, the profiled exterior of the collar latch keys 226 may not be symmetrically angled, as illustrated, but instead may include a low angled surface (e.g., 45 degrees or less) facing a "push" end of the tool 200 (e.g., a downhole end) and a steeper angled surface (e.g., 45 degrees or more) facing a "pull" end of the tool 200 (e.g., an uphole end). Alternatively, for example, depending on desired operation, a low angled surface may face a "pull" end of the tool 200 and a steeper angled surface may face a "push" end of the tool 200. The finger 228 profile may also be curved, or be a combination of curves and angled faces.

In operation, the downhole tool 200 may be actuated by a combination of hydraulic pressure and spring force exerted by the springs 222. For example, in one example operation of the downhole tool 200, the ball 232 may be dropped from the terranean surface 104 into the bore 234 of the tool 200. After the ball 232 lands on the seat 240 to create a blockage in the bore 234, hydraulic pressure is increased in the bore 234 (e.g., by circulating a working fluid 242 into the bore 234). As the hydraulic pressure increases above a specified magnitude, the working fluid 242 may flow through passages 208, which may contain filters 206 in line with fluid passages 208. Plugs 204 may help contain the working fluid 242 within the fluid passages 208 and provide access to the filters 206.

The working fluid 242 may then flow through check valves 212 into the fluid reservoirs 230. As hydraulic pressure increases within the reservoirs 230, the piston sleeves 216 are urged towards the collar latch keys 226 (e.g., urged towards an axial center of the tool 200). Seals arranged between the inner sliding sleeves 216 and the mandrel 214 and outer sleeve 220 may help retain the working fluid 242 in the fluid reservoirs 230.

As the piston sleeves 216 are urged towards the collar latch keys 226, the piston sleeves 216 contact the springs 222 and the outer sleeve 220, thereby urging the springs 222 into compression. The springs 222, in compression, then exert a spring force on the wedge sleeves 224, which are moved together and under the collar latch keys 226.

As the wedge sleeves 224 are urged together and under the collar latch keys 226 due to, for example, the angled sliding interfaces between the respective wedge sleeves 224 and collar latch keys 226, the collar latch keys 226 are urged radially towards the casing 114 and into their engaged position (e.g., with the fingers 228 extended).

In some implementations, once actuated by a particular hydraulic pressure, the pressure may be held relatively constant such that the piston sleeves 216 are held against the shoulder of the outer sleeve 220. This may provide for a relative maximum compression of the springs 222. In some aspects, for example as illustrated in FIG. 2, check valves 212 may be arranged in the fluid passages 208. The check valves 212 may be set to hold the hydraulic pressure in the reservoirs 230 at a particular pressure setpoint.

Once actuated, the downhole tool 200 may be moved (e.g., uphole or downhole) in the wellbore 102 in order to correlate depth on the casing 114, for example, through the locations of the casing collars 120 positioned between casing segments 115. For example, in the engaged position and as the downhole tool 200 is "pulled" (e.g., moved uphole) through the wellbore 102, the extended fingers 228 engage the notch 121 of the casing 114 that is formed at the particular casing collar 121. Upon engagement, the casing latch 226 may snap into the notch 121 by moving radially outward (e.g., toward the casing 114). By snapping outward, for example, due to the spring force which in turn urges the wedge sleeves 224 away from the collar latch keys 226, the tool 200 may require an increased "pull" force in order to move the tool 200 past the notch 121. Such an increased pull force may correlate the location of the tool 200 with the particular casing collar 120, thereby correlating the depth of the tool 200 in the wellbore.

This may be repeated as the tool 200 is moved uphole, for instance, past multiple casing collars 120.

In some instances, it may be desired to deactuate, or pressure down, the tool 200. In some implementations that may not include the check valve 212, for instance, deactuation may occur by reducing the hydraulic pressure of the working fluid 242 circulated to the tool 200. Once the pressure is reduced below a specified value, the piston sleeves 216 may move away from the shoulder of the outer sleeve 220, thereby releasing compression on the springs 222. In turn, the wedge sleeves 224 may move away from and out from under the collar latch keys 226, thereby releasing the latch keys 226 into their disengaged position. In some cases, selectively deactuating the collar latch keys 226 may be advantageous to, for instance, reduce wear on the tool 200 (e.g., the fingers 228), facilitate smoother releases of the latch keys 226 from the notch 121, and facilitate more discrete movement of the tool 200 in the wellbore 102.

In implementations of the tool 200 that do include the check valves 212, rupture disks 236 may be provided that are fluidly connected to the reservoirs 230 by fluid passages 238. The check valves 212 may hold the hydraulic pressure in the reservoirs 230 at a high enough pressure to maintain the tool 200 in an engaged position. In order to deactuate the tool 200, the pressure of the working fluid 242 may be increased so as to burst the rupture disks 236, thereby releasing the hydraulic pressure on the piston sleeves 216 and subsequently the springs 222 and wedge sleeves 224 as described above.

In some implementations, the downhole tool 200 may remain actuated while the working fluid 242 circulates through the downhole tool 200 to, for example, the BHA 126 or other working tool coupled to the downhole tool 200. For example, once the downhole tool 200 is actuated and the check valves 212 hold the working fluid 242 in the reservoirs 230 at a specified pressure, the ball 232 may be circulated back to the terranean surface 104 by, for example, reversing the flow of the working fluid 242 to circulate uphole through the tool 200. Once the ball 232 is removed from the wellbore 102, the working fluid 242 may then be circulated downhole again, through the tool 200 (e.g., through the bore 234) and to the BHA 126 or other working tool.

Figure 3A:
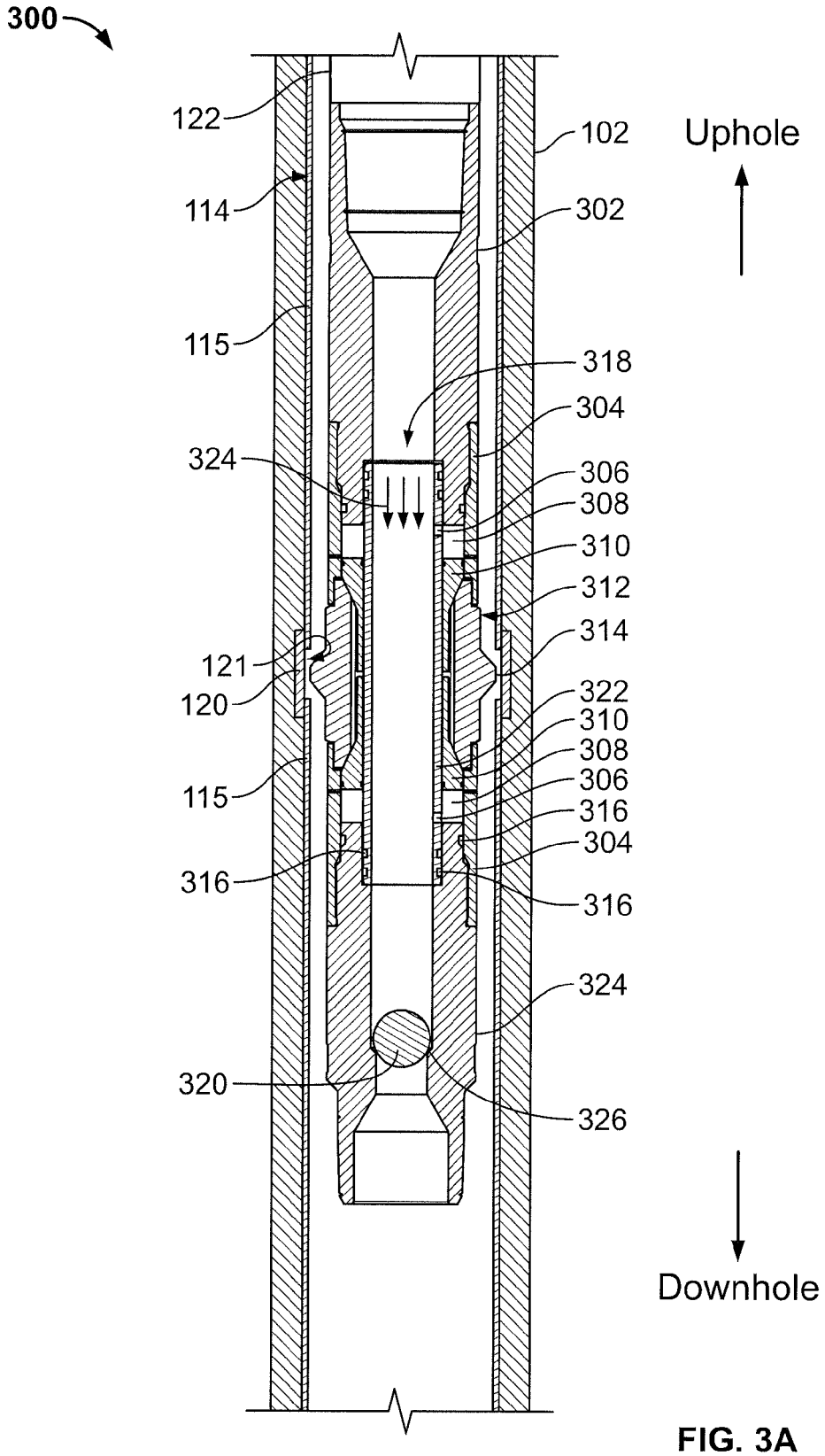
FIGS. 3A-3B are sectional views of another example implementation of a downhole tool for correlating depth on a tubular in a wellbore.
Figure 3B:
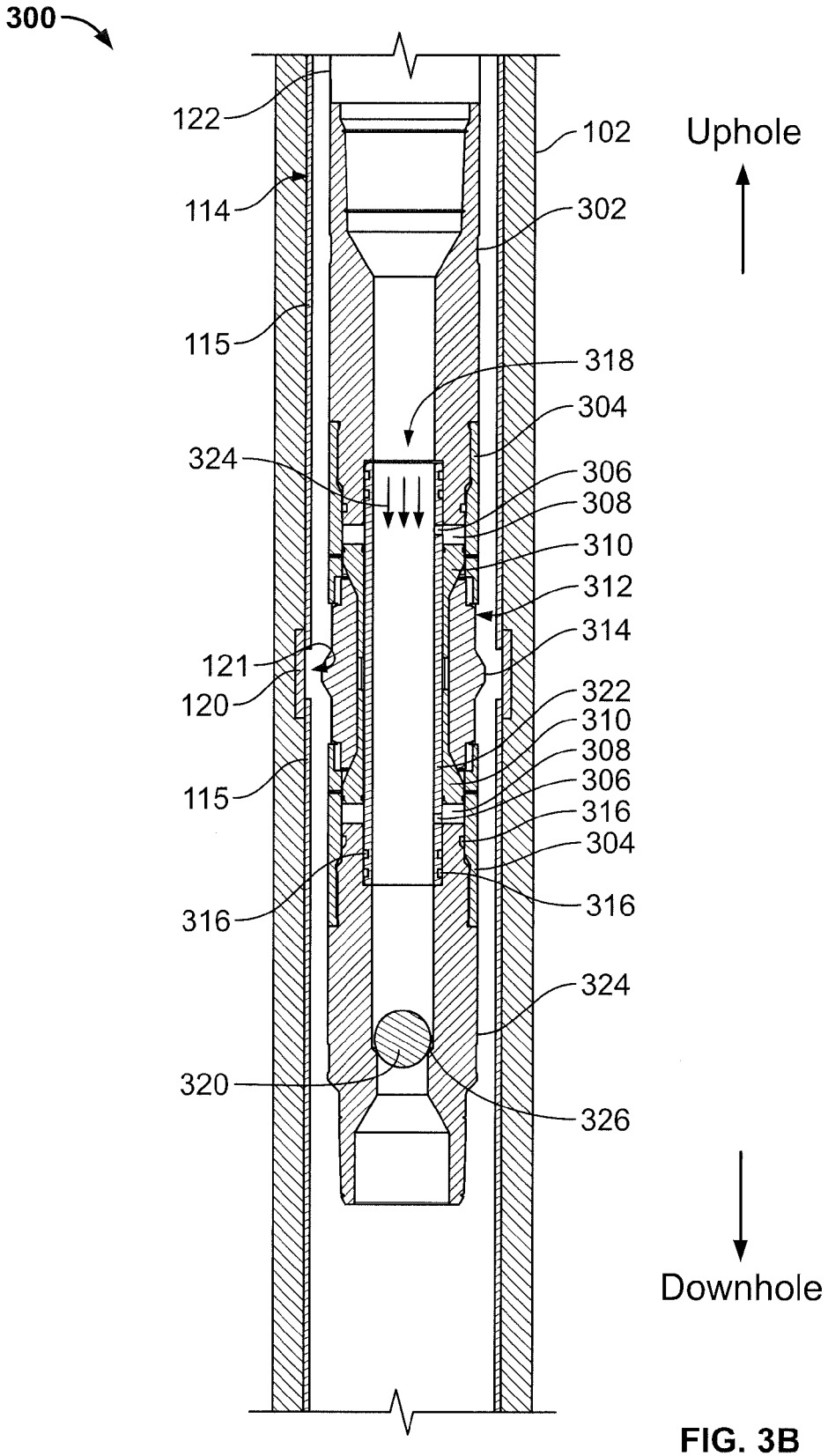

FIGS. 3A-3B are sectional views of another example implementation of a downhole tool 300 for correlating depth on a tubular in a wellbore. FIG. 3A shows the tool 300 in an engaged position while FIG. 3B shows the tool 300 in a disengaged position. For example, in some implementations, the downhole tool 300 may be used in system 100 and run into the wellbore 102 within the production casing 114. As illustrated in FIGS. 3A-3B, for instance, the downhole tool 300 is shown coupled (e.g., threadingly) to the tubing string 122 within the production casing 114 adjacent a notch 121 defined by a casing collar 120 that joins two segments 115 of the production casing 114. Generally, the downhole tool 300 may be actuated by hydraulic pressure.

The illustrated downhole tool 300 includes a top sub-assembly ("sub") 302 and bottom sub 324 that facilitate coupling engagement (e.g., threadingly) with, for instance, the tubing string 122 at the uphole end of the tool 300 and the BHA 126 (not shown in FIGS. 3A-3B) at the downhole end of the tool 300. A mandrel 322 extends between and is coupled to the top sub 302 and bottom sub 324 and defines a bore 318 that extends along a centerline axis of the tool 300. The bore 318, for example, may define a maximum diameter through which a tool, fluid, or object (e.g., a ball 320 as shown) may pass. A downhole end of the bore 318 is adjacent a seat 326 on which a ball 320 can land in the tool 300.

The illustrated tool 300 includes outer sleeve 304 that define a portion of an exterior radial surface of the tool 300 at the uphole and downhole ends of the tool 300. As shown, the outer sleeve 304 includes shoulders that face uphole and downhole ends of the tool 300, respectively, and abut the collar latch keys 312 during actuation of the tool 300.

As illustrated, wedge sleeves 310 are arranged radially between the mandrel 322 on one side and the outer sleeve 304 and collar latch keys 312 on the other side. The wedge sleeves 310 may be sealed against the mandrel 322 and the outer sleeve 304 to help contain working fluid in cavity 308. In particular, the illustrated wedge sleeves 310 include an angled (e.g., with respect to an axial centerline the tool 300) shoulder that interfaces with an angled surface of the collar latch keys 312. As described in more detail below, during operation, the angled shoulder of the wedge sleeves 310 may contactingly engage the angled surface of the collar latch keys 312 in order to radially extend the collar latch keys 312 towards the production casing 114.

The collar latch keys 312 include a profiled exterior (e.g., radial) surface, as illustrated, including a finger 314 that extends from the collar latch 312. The finger 314 may include a symmetrically angled profile, as illustrated, with a peak surface that may be treated (e.g., hardened for wear reduction), smoothed (e.g., for reduced friction engagement with the casing segments 115 and/or casing collar 120), and/or provided with a bearing surface. For example, in some implementations, the peak surface of the finger 314 may include one or more ball bearings or other bearing components that help facilitate movement of the downhole tool 300 against the casing segments 115 and past the casing collar 120 as the downhole tool 300 is moved in the wellbore 102.

In some implementations, the profiled exterior of the collar latch 312 may not be symmetrically angled, as illustrated, but instead may include a low angled surface (e.g., 45 degrees or less) facing a "push" end of the tool 300 (e.g., a downhole end) and a steeper angled surface (e.g., 45 degrees or more) facing a "pull" end of the tool 300 (e.g., an uphole end). Alternatively, for example, depending on desired operation, a low angled surface may face a "pull" end of the tool 300 and a steeper angled surface may face a "push" end of the tool 300. The finger 314 profile may also be curved, or be a combination of curves and angled faces.

In operation, the downhole tool 300 may be actuated by hydraulic pressure. For example, in one example operation of the downhole tool 300, the ball 320 may be dropped from the terranean surface 104 into the bore 318 of the tool 300. After the ball 320 lands on the seat 326 to create a blockage in the bore 318, hydraulic pressure is increased in the bore 318 (e.g., by circulating a working fluid 324 into the bore 318). As the hydraulic pressure increases, the working fluid 324 may flow through passages 306 and into fluid reservoirs 308.

As hydraulic pressure increases within the reservoirs 308, the wedge sleeves 310 may be urged together and under the collar latch keys 312 due to, for example, the angled sliding interfaces between the respective wedge sleeves 310 and collar latch keys 312, the collar latch keys 312 are urged radially towards the casing 114 and into its engaged position (e.g., with the finger 314 extended). Seals 316 arranged in the tool 300 may help retain the working fluid 324 in the fluid reservoirs 308.

In some implementations, the particular hydraulic pressure may be held relatively constant such that the wedge sleeves 310 are held in place (e.g., in an engaged position). Once actuated, the downhole tool 300 may be moved (e.g., uphole or downhole) in the wellbore 102 in order to correlate depth on the casing 114, for example, through the locations of the casing collars 120 positioned between casing segments 115. For example, in the engaged position and as the downhole tool 300 is "pulled" (e.g., moved uphole) through the wellbore 102, the extended fingers 314 engage the notch 121 of the casing 114 that is formed at the particular casing collar 120. Upon engagement, the casing latch keys 312 may snap into the notch 121 by moving radially outward (e.g., toward the casing 114). By snapping outward, the hydraulic pressure of the working fluid 324 may quickly change, e.g., spike or drop, so as to signal that the tool 300 is at the same depth as the particular casing collar 120. Pressure reduction may be enabled in the tool 300 through ports which become exposed as the wedge sleeves 310 slide to the fully engaged position. For example, such ports may be disposed through the outer sleeve 304 and in fluid communication with the bore 318 and an annulus between the tool 300 and the casing 114 (e.g., when exposed). Such a change in hydraulic pressure, for instance, at the terranean surface 104, may correlate the location of the tool 300 with the particular casing collar 120, thereby correlating the depth of the tool 300 in the wellbore. This may be repeated as the tool 300 is moved uphole, for instance, past multiple casing collars 120.

In some instances, it may be desired to deactuate, or pressure down, the tool 300. In some implementations, deactuation may occur by reducing the hydraulic pressure of the working fluid 324 circulated to the tool 300. Once the pressure is reduced below a specified value, the wedge sleeves 310 may move away from and out from under the collar latch keys 312, thereby releasing the latch keys 312 into their disengaged position. In some cases, selectively deactuating the collar latch keys 312 may be advantageous to, for instance, reduce wear on the tool 300 (e.g., the fingers 314), facilitate smoother releases of the latch 312 from the notch 121, and facilitate more discrete movement of the tool 300 in the wellbore 102.

Figure 4A:
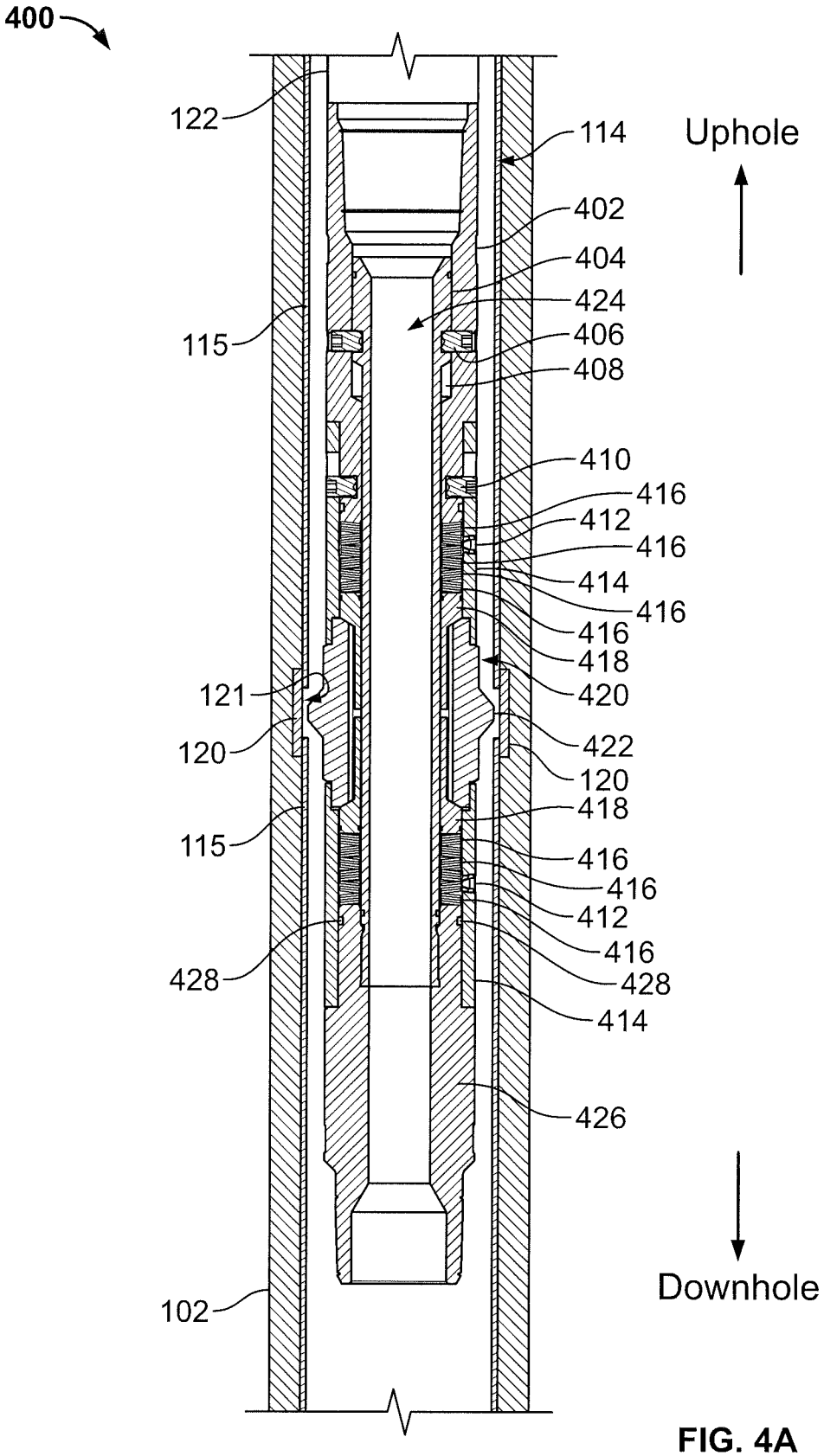
FIGS. 4A-4B are sectional views of another example implementation of a downhole tool for correlating depth on a tubular in a wellbore.
Figure 4B:
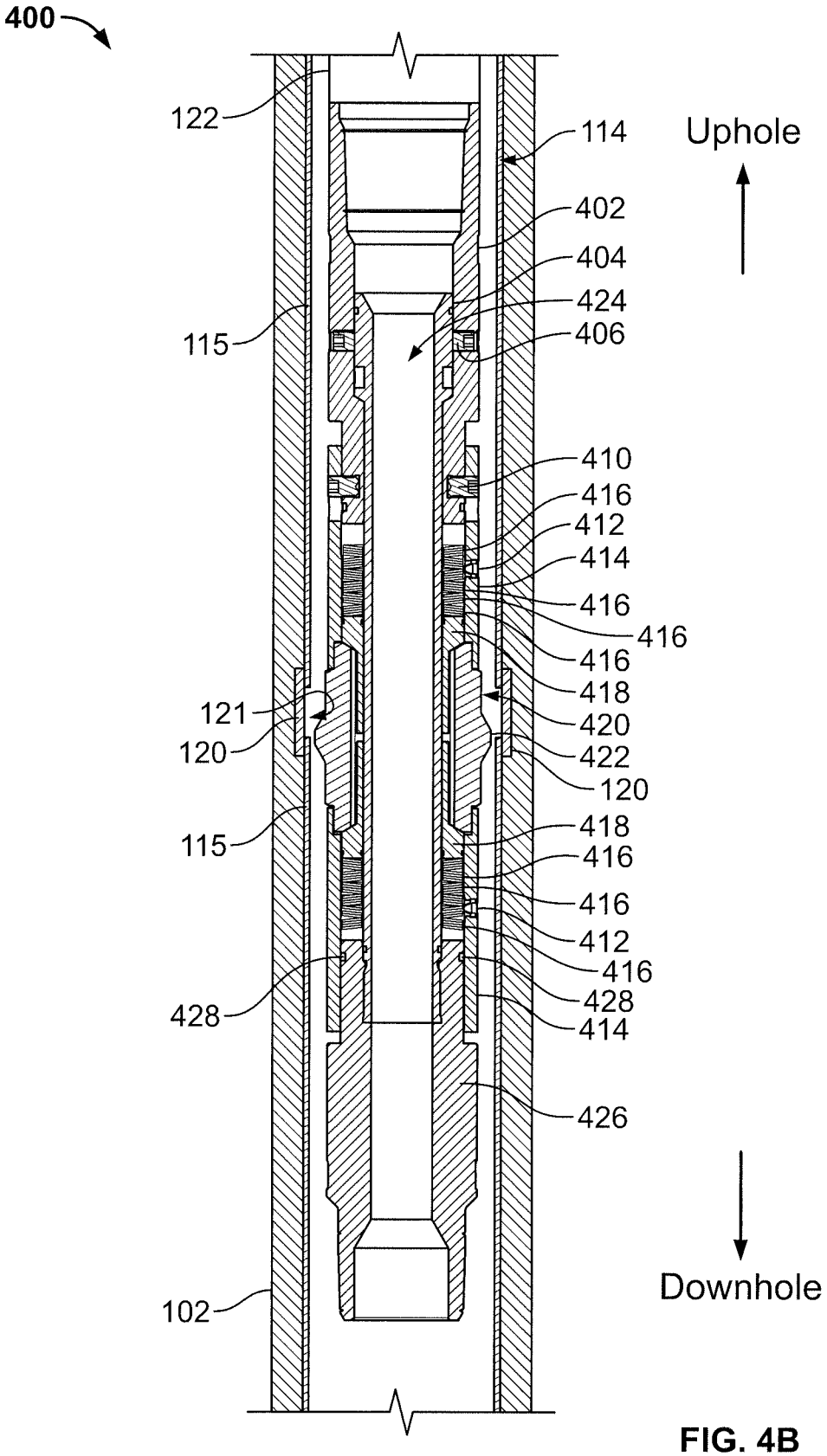

FIGS. 4A-4B are sectional views of another example implementation of a downhole tool 400 for correlating depth on a tubular in a wellbore. FIG. 4A shows the tool 400 in an engaged position while FIG. 4B shows the tool 400 in a disengaged position. For example, in some implementations, the downhole tool 400 may be used in system 100 and run into the wellbore 102 within the production casing 114. As illustrated in FIGS. 4A-4B, for instance, the downhole tool 400 is shown coupled (e.g., threadingly) to the tubing string 122 within the production casing 114 adjacent a notch 121 defined by a casing collar 120 that joins two segments 115 of the production casing 114. Generally, the downhole tool 400 may be actuated by mechanical (e.g., spring) force. Further, in some implementations, the downhole tool 400 may be in an engaged position (e.g., shown in FIG. 4A) substantially throughout its operation.

The illustrated downhole tool 400 includes a top sub-assembly ("sub") 402 and bottom sub 426 that facilitate coupling engagement (e.g., threadingly) with, for instance, the tubing string 122 at the uphole end of the tool 400 and the BHA 126 (not shown in FIGS. 4A-4B) at the downhole end of the tool 400. A mandrel 404 extends between and is coupled to the top sub 402 and bottom sub 426 and defines a bore 424 that extends along a centerline axis of the tool 400. The bore 424, for example, may define a maximum diameter through which a tool, fluid, or object may pass.

As illustrated in FIG. 4A particularly, the mandrel 404 is coupled to the top sub 402 by one or more pins 406, or other load-limiting feature. FIG. 4A shows the pins 406 intact, while FIG. 4B shows the pins 406 sheared so as to adjust the tool 400 from the engaged position in FIG. 4A (e.g., with springs 416 compressed) to an unengaged position in FIG. 4B (e.g., with springs 416 relaxed).

The illustrated tool 400 includes an outer sliding sleeve 414 that define a portion of an exterior radial surface of the tool 400 at the uphole and downhole ends of the tool 400. The outer sliding sleeve 414, as illustrated, may optionally be slideably coupled to the top sub 402 and bottom sub 426, respectively, through pins 410. As shown, the outer sliding sleeve 414 include shoulders that face uphole and downhole ends of the tool 400, respectively, and abut the collar latch keys 420 of the tool 400.

As illustrated, axial surfaces of the top sub 402 and bottom sub 426 may abut springs 416. As shown in FIG. 4A, for example, when actuated, the axial surfaces of the top sub 402 and bottom sub 426 may compress the springs 416. In the disengaged position, the axial surfaces of the top sub 402 and bottom sub 426 may be urged away from the springs 416 so as to allow the springs 416 to adjust to an uncompressed state.

The springs 416, in the illustrated implementation, include one or more disc springs (e.g., Belleville washers) stacked between the subs 402 and 426 and wedge sleeves 418. The springs 416, however, may be other forms of potential energy devices, such as, for example, coiled springs, elastomeric devices, or other devices. For example, in some alternative implementations, the springs 416 illustrated in FIGS. 4A-4B each comprise a single coiled spring arranged to apply a spring force to a respective wedge sleeves 418. In any event, the springs 416 may be selected based, for example, on a collective spring force exertable by the springs 416 on the wedge sleeves 418. Further, the springs 416 may be selected based on a desired pull out force of the tool 400 from the wellbore 102 or from the notches 121.

As illustrated, wedge sleeves 418 are arranged radially between the mandrel 404 on one side and the outer sliding sleeve 414 and collar latch keys 420 on the other side. In particular, the illustrated wedge sleeves 418 include an angled (e.g., with respect to an axial centerline the tool 400) shoulder that interfaces with an angled surface of the collar latch keys 420. As described in more detail below, during operation, the angled shoulder of the wedge sleeves 418 may contactingly engage the angled surface of the collar latch keys 420 in order to radially extend the collar latch keys 420 towards the production casing 114.

The collar latch keys 420 includes a profiled exterior (e.g., radial) surface, as illustrated, including a finger 422 that extends from the collar latch key 420. The finger 422 may include a symmetrically angled profile, as illustrated, with a peak surface that may be treated (e.g., hardened to reduce wear), smoothed (e.g., for reduced friction engagement with the casing segments 115 and/or casing collar 120), and/or provided with a bearing surface. For example, in some implementations, the peak surface of the finger 422 may include one or more ball bearings or other bearing components that help facilitate movement of the downhole tool 400 against and past the casing segments 115 and/or collar 120 as the downhole tool 400 is moved in the wellbore 102.

In some implementations, the profiled exterior of the collar latch 422 may not be symmetrically angled, as illustrated, but instead may include a low angled surface (e.g., 45 degrees or less) facing a "push" end of the tool 400 (e.g., a downhole end) and a steeper angled surface (e.g., 45 degrees or more) facing a "pull" end of the tool 400 (e.g., an uphole end). Alternatively, for example, depending on desired operation, a low angled surface may face a "pull" end of the tool 400 and a steeper angled surface may face a "push" end of the tool 400 The finger 422 profile may also be curved, or be a combination of curves and angled faces.

In operation, the downhole tool 400 may be initially set in the engaged position as illustrated in FIG. 4A (e.g., with the collar latch keys 420 extended radially outward). For example, the collar latch keys 420 may be urged radially outward by the wedge sleeves 418, which in turn are urged together due to the spring force of the springs 416 in their compressed state. Once actuated, the downhole tool 400 may be moved (e.g., uphole or downhole) in the wellbore 102 in order to correlate depth on the casing 114, for example, through the locations of the casing collars 120 positioned between casing segments 115. For example, in the engaged position and as the downhole tool 400 is "pulled" (e.g., moved uphole) through the wellbore 102, the extended fingers 422 engage the notch 121 of the casing 114 that is formed at the particular casing collar 121. Upon engagement, the casing latch 426 may snap into the notch 121 by moving radially outward (e.g., toward the casing 114). By snapping outward, the tool 400 may require an increased "pull" force in order to move the tool 400 past the notch 121. Such an increased pull force may correlate the location of the tool 400 with the particular casing collar 120, thereby correlating the depth of the tool 400 in the wellbore. This may be repeated as the tool 400 is moved uphole, for instance, past multiple casing collars 120.

In some instances, it may be desired to deactuate the tool 400, e.g., adjust the collar latch keys 420 from an engaged position to a disengaged position. In some implementations, deactuation may occur by, for instance, tension, compression, or rotation to the top sub 402 in order to break the pins 406. Once such pins 406 are sheared, the top sub 402 and bottom sub 426 may adjust axially away from the collar latch keys 420. For example, as shown in FIG. 4B, the mandrel 404 adjusts downhole into a space 408 between the mandrel 404 and top sub 402 that exists when the tool 400 is in the engaged position. As the top sub 402 and bottom sub 426 are urged away from the springs 416, the springs 416 may decompress, thereby allowing the wedge sleeves 418 to move away from and out from under (at least partially) the collar latch keys 420. The collar latch keys 420 may retract radially, e.g., away from the casing 114 into the disengaged position of the tool 400.

In some implementations, the tool 400 may be deactuated by hydraulic pressure. For example, a ball (not shown) or other component may be inserted into the bore 424 to a seat at a downhole end of the tool 400. Fluid may be circulated through the bore 424 to the ball, thereby urging the mandrel 404 in a downhole direction. As the fluid pressure increases, the pins 406 may break, thereby adjusting the top sub 402 and bottom sub 426 axially away from the collar latch keys 420. As shown in FIG. 4B, the mandrel 404 adjusts downhole into a space 408 between the mandrel 404 and top sub 402 that exists when the tool 400 is in the engaged position. As the top sub 402 and bottom sub 426 are urged away from the springs 416, the springs 416 may decompress, thereby allowing the wedge sleeves 418 to move away from and out from under (at least partially) the collar latch keys 420. The collar latch keys 420 may retract radially, e.g., away from the casing 114 into the disengaged position of the tool 400.

A number of implementations have been described. Nevertheless, it will be understood that various modifications may be made. For example, although some implementations are discussed in terms of a casing collar locator, one or more of the downhole tools 200, 300, and/or 400 may also be used as an anchor or centralizer when latched into a collar or other suitable profile. As another example, one or more of the downhole tools 200, 300, and/or 400 may be used as a reaction force device to enable shifting another downhole tool (e.g., similar to drag blocks), but more positively due to mechanical engagement of the tool and the profile rather than only relying on a frictional force. Further, in some example methods, the downhole tool 200, 300, and/or 400 may be located "uphole" in a tubing string (e.g., coiled tubing, jointed pipe, or a combination thereof) that is also coupled to a BHA located hundreds or more feet away from the downhole tool. When run into a wellbore having cased portion and an uncased portion, position of the BHA in the uncased openhole portion may be determined by correlating a depth of the downhole tool in the cased portion. Accordingly, other implementations are within the scope of the following claims.

What is claimed is:

1. A casing collar locator tool, comprising:

a tubular mandrel defining a bore therethrough;

a top sub-assembly and a bottom sub-assembly carried on the tubular mandrel;

a profile carried on the tubular mandrel axially between the top sub-assembly and bottom sub-assembly and adjustable between an engaged state defined by the profile extending radially away from the mandrel and a disengaged state defined by the profile retracted towards the mandrel, the profile formed to engage a notch formed by a casing collar that joins tubular wellbore members;

a hydraulically-actuated wedge sleeve carried on the tubular mandrel between the top sub-assembly and the bottom sub-assembly and arranged, at least in part, axially adjacent the profile, the wedge sleeve actuatable to urge the profile into at least one of the engaged state or the disengaged state;

a sliding piston sleeve carried on the tubular mandrel;

an outer sleeve carried, at least in part, on the sliding piston sleeve, the outer sleeve comprising a shoulder adjacent an axial end of the sliding piston sleeve; and a spring arranged between the wedge sleeve and the sliding piston sleeve, the spring comprising a first surface adjacent the axial end of the sliding piston sleeve and a second surface adjacent an end of the moveable wedge sleeve opposite an interface surface of the wedge sleeve that is axially adjacent the profile.

2. The tool of claim 1, further comprising:

a reservoir in fluid communication with the bore through a fluid passage, the reservoir arranged axially between the sliding piston sleeve and one of the top sub-assembly or the bottom sub-assembly.

3. The tool of claim 2, further comprising:

a check valve arranged in the fluid passage between the reservoir and the bore; and a rupture member in fluid communication with the reservoir and an annulus between the tool and a wellbore.

4. The tool of claim 1, wherein the wedge sleeve is hydraulically-actuated, and the tool further comprises:

a reservoir in fluid communication with the bore through a fluid passage, the reservoir arranged axially between the wedge sleeve and one of the top sub-assembly or the bottom sub-assembly.

5. The tool of claim 1, wherein the profile comprises:

a base surface; and a plateau surface connected to the base surface by one or more angled or curved surfaces.

6. The tool of claim 5, wherein the plateau surface comprises:

a reduced friction surface relative to the base surface; or a hardened surface relative to the base surface.

7. The tool of claim 5, wherein the one or more angled surfaces comprise:

a first surface angled from the base surface at about 45 degrees or less relative to an axial centerline of the tool; and a second surface angled from the base surface at between about 45 degrees and about 90 degrees relative to the axial centerline of the tool.

8. The downhole tool of claim 1, further comprising:

a spring axially arranged between the wedge sleeve and the top sub-assembly;

a pin that connects the top sub-assembly to the tubular mandrel, the pin breakable to actuate the wedge sleeve to urge the profile into the disengaged state; and a gap that extends radially about the tubular mandrel between the tubular mandrel and the top sub-assembly adjacent the pin, the tubular mandrel moveable into the gap to release the spring from compression.

9. The tool of claim 1, wherein the wedge sleeve comprises an interface surface that faces one of an uphole axial surface or a downhole axial surface of the profile, the interface surface and the uphole axial surface angled relative to an axial centerline of the tool.

10. The tool of claim 1, wherein the profile is carried on an extended surface of the wedge sleeve that is positioned radially between the mandrel and an inner surface of the profile.

11. A downhole tool, comprising:

a casing collar locator, comprising:

a tubular mandrel comprising a bore therethrough;

a top sub-assembly carried on the mandrel and adapted to be coupled to a tubing that is run into a wellbore;

a bottom sub-assembly carried on the mandrel and adapted to be coupled to a bottom hole assembly;

a collar latch carried on the mandrel and adapted to adjust between an actuated position in contact with a casing collar and a deactuated position not in contact with the casing collar in response to a force applied to an axial surface of the collar latch by a force-actuated piston, the collar latch adjustable, while in the actuated position with force applied by the force-actuated piston, between an extended position engageable with a casing collar that couples tubular members and a retracted position engageable with an inner radial surface of at least one of the tubular members during movement of the downhole tool in an uphole direction and during movement of the downhole tool in a downhole direction.

12. The downhole tool of claim 11, further comprising one or more spring members arranged between the collar latch and a hydraulically-actuated piston, the one or more spring members adapted to apply a spring force to the collar latch based on a hydraulic pressure applied to the piston.

13. The downhole tool of claim 11, wherein the collar latch is adapted to radially extend away from the tubular mandrel while in the actuated position.

14. The downhole tool of claim 11, wherein the force-actuated piston comprises a hydraulically-actuated piston.

15. A casing collar locator tool, comprising:

a tubular mandrel defining a bore therethrough;

a top sub-assembly and a bottom sub-assembly carried on the tubular mandrel;

a profile carried on the tubular mandrel axially between the top sub-assembly and bottom sub-assembly and adjustable between an engaged state defined by the profile extending radially away from the mandrel and a disengaged state defined by the profile retracted towards the mandrel;

a hydraulically-actuated wedge sleeve carried on the tubular mandrel between the top sub-assembly and the bottom sub-assembly and arranged, at least in part, axially adjacent the profile, the wedge sleeve actuatable to urge the profile into at least one of the engaged state or the disengaged state;

a sliding piston sleeve carried on the tubular mandrel;

an outer sleeve carried, at least in part, on the sliding piston sleeve, the outer sleeve comprising a shoulder adjacent an axial end of the sliding piston sleeve;

a spring arranged between the wedge sleeve and the sliding piston sleeve, the spring comprising a first surface adjacent the axial end of the sliding piston sleeve and a second surface adjacent an end of the moveable wedge sleeve opposite an interface surface of the wedge sleeve that is axially adjacent the profile;

a reservoir in fluid communication with the bore through a fluid passage, the reservoir arranged axially between the sliding piston sleeve and one of the top sub-assembly or the bottom sub-assembly;

a check valve arranged in the fluid passage between the reservoir and the bore; and a rupture member in fluid communication with the reservoir and an annulus between the tool and a wellbore.

16. A casing collar locator tool, comprising:

a tubular mandrel defining a bore therethrough;

a top sub-assembly and a bottom sub-assembly carried on the tubular mandrel;

a profile carried on the tubular mandrel axially between the top sub-assembly and bottom sub-assembly and adjustable between an engaged state defined by the profile extending radially away from the mandrel and a disengaged state defined by the profile retracted towards the mandrel, the profile formed to engage a notch formed by a casing collar that joins tubular wellbore members;

a hydraulically-actuated wedge sleeve carried on the tubular mandrel between the top sub-assembly and the bottom sub-assembly and arranged, at least in part, axially adjacent the profile, the wedge sleeve actuatable to urge the profile into at least one of the engaged state or the disengaged state; and a reservoir in fluid communication with the bore through a fluid passage, the reservoir arranged axially between the wedge sleeve and one of the top sub-assembly or the bottom sub-assembly.

17. The casing collar locator tool of claim 16, wherein the profile comprises:

a base surface; and a plateau surface connected to the base surface by one or more angled or curved surfaces.

18. The casing collar locator tool of claim 17, wherein the plateau surface comprises:

a reduced friction surface relative to the base surface; or a hardened surface relative to the base surface.

19. The casing collar locator tool of claim 17, wherein the one or more angled surfaces comprise:

a first surface angled from the base surface at about 45 degrees or less relative to an axial centerline of the tool; and a second surface angled from the base surface at between about 45 degrees and about 90 degrees relative to the axial centerline of the tool.

20. The casing collar locator tool of claim 15, wherein the profile comprises:

a base surface; and a plateau surface connected to the base surface by one or more angled or curved surfaces.

21. The casing collar locator tool of claim 20, wherein the plateau surface comprises:

a reduced friction surface relative to the base surface; or a hardened surface relative to the base surface.

22. The casing collar locator tool of claim 20, wherein the one or more angled surfaces comprise:

a first surface angled from the base surface at about 45 degrees or less relative to an axial centerline of the tool; and a second surface angled from the base surface at between about 45 degrees and about 90 degrees relative to the axial centerline of the tool.

* * * * *

UNITED STATES PATENT AND TRADEMARK OFFICE

CERTIFICATE OF CORRECTION

PATENT NO. : 9,217,316 B2
APPLICATION NO. : 13/495849
DATED : December 22, 2015
INVENTOR(S) : Muhammad Asif Ehtesham et al.

It is certified that error appears in the above-identified patent and that said Letters Patent is hereby corrected as shown below:

In the Claims:

Column 15, line 7, in Claim 8, delete "downhole tool" and insert -- tool --, therefor.

Signed and Sealed this
Seventeenth Day of May, 2016

Michelle K. Lee

Michelle K. Lee
*Director of the United States Patent and Trademark Office*